US005470011A

United States Patent [19]

Jordan

[11] Patent Number: 5,470,011

[45] Date of Patent: Nov. 28, 1995

[54] BEVERAGE DISPENSING URN AND DRIP COLLECTOR DEVICE

[76] Inventor: Anita E. Jordan, 403 Centre Blvd., Greenville, S.C. 29605-5803

[21] Appl. No.: 235,913

[22] Filed: May 2, 1994

[51] Int. Cl.[6] ..... B67D 1/16

[52] U.S. Cl. ..... 222/108

[58] Field of Search ..... 222/108, 185, 222/571; 137/312–314; 141/87, 88

[56] References Cited

U.S. PATENT DOCUMENTS

| | | | |
|---|---|---|---|
| Re. 5,876 | 5/1874 | Hitchcock | 222/108 |
| 401,487 | 4/1889 | Ellis | 141/88 |
| 457,458 | 8/1891 | Britton et al. | 222/108 |
| 669,481 | 5/1902 | Boyd | 222/108 |
| 702,181 | 6/1902 | Boyd | 222/108 |
| 1,224,572 | 5/1917 | Schoen | 141/88 |
| 1,703,284 | 2/1929 | Wolfe | 222/108 |
| 2,761,288 | 9/1956 | Anderson et al. | 222/108 |

FOREIGN PATENT DOCUMENTS

| | | | |
|---|---|---|---|
| 768536 | 8/1934 | France | 137/313 |
| 1660 | of 1896 | United Kingdom | 137/313 |
| 461536 | 2/1937 | United Kingdom | 137/313 |

*Primary Examiner*—William A. Cuchlinski, Jr.
*Assistant Examiner*—Philippe Derakshani
*Attorney, Agent, or Firm*—Gerald R. Boss; Cort Flint

[57] ABSTRACT

A beverage dispenser and drip collection device is disclosed wherein the collection device may be attached to a spigot of a beverage dispenser. In the illustrated embodiment, the collection device comprises a rear retaining member having a spigot slot which attaches to the spigot and a collection reservoir disposed below the spigot slot for collecting drips and overflows. The dimension of the spigot slot, height of the retaining member, and top of the collection reservoir are such that a beverage dispensing position is defined between the spigot outlet and the top of the collection reservoir which receives a beverage cup during dispensing in a manner that drips are caught after the cup is removed as well as overflows caught when the cup is in place. Spaced, contoured side walls are carried by the retaining member and form part of the collection reservoir. The contoured side walls have cut-away edges to facilitate placement of the beverage cup in the beverage dispensing position.

13 Claims, 1 Drawing Sheet

BEVERAGE DISPENSING URN AND DRIP COLLECTOR DEVICE

BACKGROUND OF THE INVENTION

This invention relates to a device for collecting beverage drips from a beverage dispensing urn during dispensing which may be used in combination with a wide variety of different dispensing urns.

Previously, drip collection devices have been known for collecting drips from associated devices. For example, U.S. Pat. No. 005,876 discloses a coffee urn having a drip collector which moves in and out of position to collect drips form a spigot. U.S. Pat. Nos. 699,481 and 702,181 show drip collection attachments for dispensing apparatus. However, none of these devices are entirely suitable for combination with different types of dispensing devices. Nor, do they permit a cup into which a beverage is being dispensed to be positioned with the drip collector in place.

U.S. Pat. No. 2,761,288 shows a typical drip collector for beverage dispensing such as used in refrigerator cabinets which does permit placement of a cup. Such drip collectors are also well known in coin-operated cup type beverage dispensing machines wherein a cup is placed on a grid and filled with a beverage. Below the grid is normally a reservoir for collecting overflow or drips. However, as would be expected these drip collectors are not removable for use in combination with different types of beverage dispenses. Typically, for large banquets, dinners, luncheons, seminars, etc. held in commercial facilities such as hotels and restaurants, coffee and other beverages are dispensed from large urns having spigots for dispensing the beverage which is controlled by a spigot handle. Typically, the spigot drips a considerable amount during the repeated dispensing operations when serving large crowds. Often, most of the dripping occurs right after the spigot handle is released as the beverage cup is being removed from underneath the spigot. Since the beverage urns and dispensers come in a wide variety of sizes and shapes, as well as various faucet and spigot configurations for controlling the flow of beverages, it is desirable to have a beverage collection device that may be readily used in combination with a wide variety of urns and dispensers.

Accordingly, an object of the invention is to provide a simple drip collection device which may be readily used in combination with a wide variety of a different type of beverage urns and dispensers for collecting drips automatically from the spigots and valves used on the urns and dispensers.

Another object of the invention is to provide a drip collection device in the form of an attachment which may be readily used in combination with a beverage urn and affixed to the spigot of the urn in a position and manner so that drips are reliably collected.

Another object of the invention is to provide a drip collection device for attachment to the spigot of a beverage urn in a manner that a cup positioned under the spigot is positioned over a collection reservoir to reliably collect drips and overflows.

SUMMARY OF THE INVENTION

The above objectives are accomplished according to the invention by providing a drip collection device and a beverage dispenser having a spigot with a spigot handle for manual operation of the spigot to control the flow of beverage through a spigot outlet. The drip collection device has an elongated rear retaining member and a vertical spigot slot formed in the rear retaining member for attaching the drip collection device to the spigot. A drip collection reservoir is carried by a lower portion of the rear retaining member positioned directly below the spigot outlet for collecting drips from the spigot outlet. A pair of spaced, contoured side walls are carried by the rear retaining member which begin at an upper portion of the retaining member and terminate at an upper edge of the collection reservoir. The side walls are spaced apart a distance sufficient to receive a beverage cup positioned between the spaced side walls when the cup is in a dispensing position below the spigot. The side walls further include a contoured outer edge which curves inwardly and diverges outwardly to the upper edge of the reservoir to permit convenient holding of a beverage cup in the beverage dispensing position between the side walls.

A spigot/reservoir height is defined between the spigot outlet and the upper edge of the collection reservoir which is generally greater than the height of a beverage cup so that the beverage cup may be conveniently placed in the beverage dispensing position.

The contoured side walls form side walls of the drip collection reservoir which includes a front wall which acts to bridge the contoured side walls defining the collection reservoir, together with a bottom wall. The rear retaining member, spaced contoured side walls, front wall, and bottom wall have a single, unitary construction.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
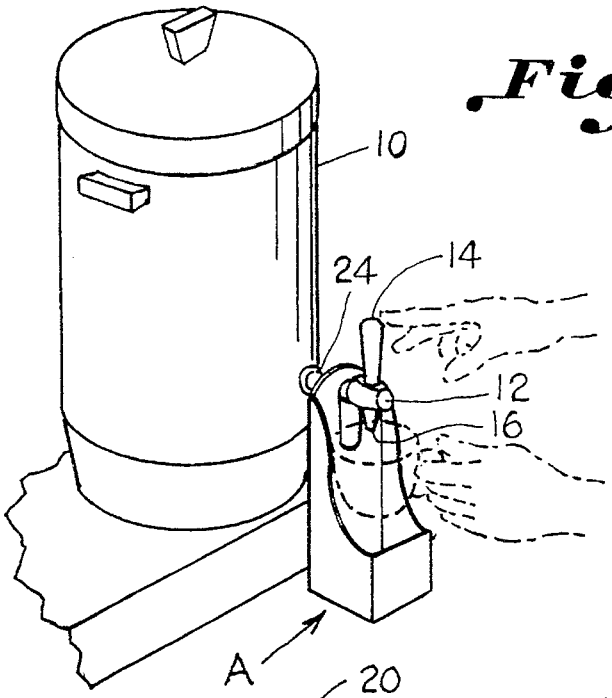
FIG. 1 is a perspective view of a beverage urn and drip collection device according to the invention.

Referring now in more detail to the drawings, the invention will now be described in more detail. FIG. 1 demonstrates a beverage urn 10 having a spigot 12, and a spigot handle 14 for controlling the flow of beverage to a spigot outlet 16. Beverage urn 10 may be any beverage containing vessel such as a coffee or tea urn. Spigot 12 may be any manually controlled valve for controlling the flow of beverage from the vessel spigot or faucet. In FIG. 1, an embodiment of a drip collection device, designated generally as A, is illustrated in combination with a beverage urn.

Figure 2A:
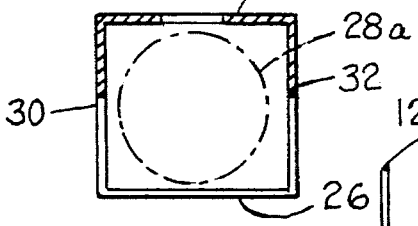
FIG. 2*a* is a section of a top plan view of a beverage cup placed in a beverage dispensing position taken generally through lines 2*a*—2*a* of FIG. 2.
Figure 3:
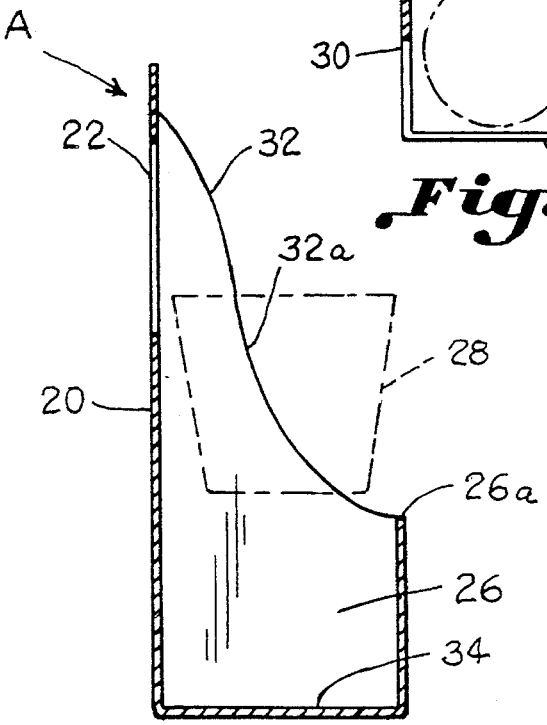
FIG. 3 is a sectional view taken along line 3—3.
Figure 2:
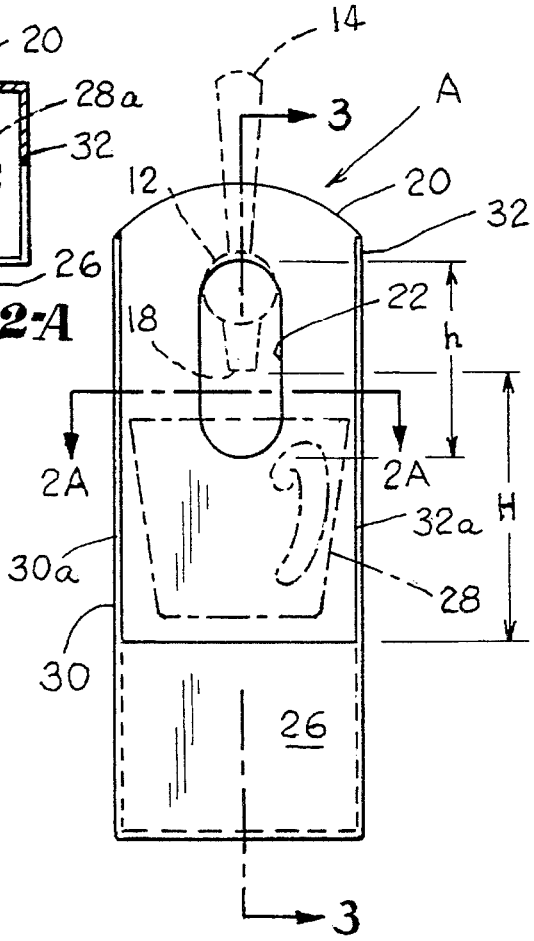
FIG. 2 is a front elevation of a drip collection device constructed according to the invention.

As can best be seen in FIGS. 2 and 3, drip collection device A includes a rear retaining member 20, and a slot attachment in the form of vertical spigot slot 22, in the illustrated embodiment, which is formed in the rear retaining member. Spigot slot 22 has a vertical height "h" which is of a sufficient extent to permit practically any spigot and spigot handle to be received through the slot so that retaining member 20 may be suspended from a pipe fitting 24, or other part, of the spigot, as can best be seen in FIG. 1. A collection reservoir 26 is carried by rear retaining member 20 at a lower portion thereof.

As can best be seen in FIG. 3, a spigot/reservoir "H" is defined between spigot outlet 16 and a top of reservoir 26. Spigot reservoir "H" is generally greater than the height of a beverage cup, such as a coffee cup 28 having a top 28*a*, so that a beverage dispensing cup may be positioned between spigot outlet 16 and collection reservoir 26 for the reliable collection of drips and cup overflow.

As can best be seen in FIGS. 1 and 3, drip collection device, or collector, designated generally as A further includes spaced contoured side walls 30, 32 which begin near an upper portion of rear retaining member 20 and include scalloped edges 30*a*, 32*a* which curve inwardly and outwardly toward top edge 26*a* of collection reservoir 26 defining the top of the reservoir. The contour of the sidewalls provides for easy placement of the beverage cup directly beneath the spigot and above the collection reservoir while grasped by a person. In this manner, a sufficient space between the side walls and shape exist for positioning beverage cup 28 within the contoured side walls to provide for positioning of the cup with its handle turned to the side for easy use. A bottom wall 34 completes construction of the collection reservoir. While the reservoir is rectangular, other shapes may also be utilized. However, it is preferred that the rectangular cross-section of the collection reservoir be generally greater than the cross-sectional area of a top of a standard beverage cup to catch any overflow, as can best be seen in FIG. 2*a*.

Preferably, the rear retaining member, contoured sidewalls, front wall, and bottom wall of the device are one-piece and molded from plastic, or other suitable material.

Thus, it can be seen that an advantageous construction can be had for a drip collection device according to the invention where it can be readily attached and removed from a wide variety of beverage dispensers. When installed over the spigot of the beverage dispenser, the drip collection device allows for easy positioning of a beverage cup below the spigot, and filling of the beverage cup. After filling, the collection reservoir of the collection device is positioned reliably for collecting any drips or overflow from the cup as the cup is moved away. The contoured sides of the collection device provides for easy positioning and removal of the coffee cup and holding of the coffee cup during dispensing.

While a preferred embodiment of the invention has been described using specific terms, such description is for illustrative purposes only, and it is to be understood that changes and variations may be made without departing from the spirit or scope of the following claims.

What is claimed is:

1. A drip collection device for use with a beverage dispenser of the type having a spigot with a spigot actuator for manual operation of the spigot to control the flow of beverage from a spigot outlet, wherein said device comprises:

an elongated rear retaining member;

an elongated vertical spigot slot formed in said rear retaining member having an upper slot end and a lower slot end, and a vertical slot height defined between said upper and lower slot end sufficiently dimensioned to receive said spigot through said slot so that said rear retaining member may be moved vertically relative to said spigot for engagement of said upper slot end with said spigot and attachment to said spigot; and a drip collection reservoir carried by a lower unitarily formed portion of said rear retaining member positioned directly below said spigot outlet for collecting drips from said spigot outlet.

2. The device of claim 1 wherein said drip collection device comprises a pair of spaced, contoured side walls carried by said rear retaining member which begin at an upper portion of said retaining member and terminate at an upper edge of said collection reservoir, said contoured side walls being spaced apart a distance sufficient to receive a beverage cup positioned between said spaced side walls when said cup is in a dispensing position below said spigot.

3. The device of claim 2 wherein said side walls comprise a contoured outer edge which curves inwardly with respect to said upper edge of said reservoir and diverges outwardly with respect to said upper edge of said reservoir so that said contoured outer edges permit access and convenient holding of a beverage cup in said beverage dispensing position between said side walls below said spigot.

4. The device of claim 2 including a spigot/reservoir height defined between said spigot outlet and an upper edge of said collection reservoir which is generally greater than the height of a beverage cup so that said beverage cup may be conveniently placed in a beverage dispensing position.

5. The device of claim 2 wherein said contoured side walls form side walls of said drip collection reservoir; said retaining member forming a rear wall of said reservoir, and including a front wall bridging said contoured side walls, and a bottom wall integral with said side walls, front wall, and rear wall to define said collection reservoir.

6. The device of claim 5 wherein said rear retaining member, spaced contoured side walls, bottom wall, and front wall comprise a single, one-piece construction.

7. The device of claim 1 wherein said spigot slot is closed about its entire periphery, said elongated rear retaining member extending from said drip collection reservoir to a height above said slot.

8. The device of claim 1 wherein said spigot actuator includes a vertically extending spigot handle, said vertical slot height being dimensioned relative to said vertical handle so that said retaining member may be received over said spigot handle and spigot.

9. The device of claim 5 wherein said rear wall, said front wall, said bottom wall, and said contoured side walls define said collection reservoir having a rectangular cross-section.

10. A drip collection device for use with a beverage dispenser of the type having a spigot with a spigot actuator for manual operation of the spigot to control the flow of beverage, wherein said device comprises:

an elongated rear retaining member;

an elongated vertical spigot slot formed in said rear retaining member having an upper slot end and a lower slot end, and a vertical slot height defined between said upper and lower slot end sufficiently dimensioned to receive said spigot through said slot so that said retaining member may receive and move vertically relative to said spigot for engagement of said upper slot end and spigot for attachment of said retaining member to said spigot;

a drip collection reservoir carried by a lower unitarily formed portion of said rear retaining member positioned directly below said spigot outlet for collecting drips from said spigot outlet; and a spigot reservoir height defined between said spigot outlet and an upper edge of said collection reservoir which is generally greater than the height of a beverage cup so that said beverage cup may be conveniently placed in a beverage dispensing position.

11. The device of claim 10 including a pair of spaced, contoured side walls carried by said rear retaining member which begin at an upper portion of said retaining member and terminate at an upper edge of said collection reservoir, said contoured side walls being spaced apart a distance sufficient to receive a beverage cup positioned between said spaced side walls when said cup is in a dispensing position below said spigot.

12. The device of claim 11 wherein said side walls comprise a contoured outer edge which is curved inwardly with respect to said upper edge of said reservoir and diverges outwardly with respect to said upper edge of said reservoir so that said contoured outer edges permit access and convenient holding of a beverage cup in said beverage dispensing position between said side walls below said spigot;

a bottom wall extending outward from said rear retaining member;

contoured side walls for abutting said bottom wall form side walls of said drip collection reservoir, and including a front wall extending upward from said bottom wall bridging said contoured side walls to define said collection reservoir; and said rear retaining member, spaced contoured side walls, said bottom wall and front wall, comprise a single, unitary construction.

13. The device of claim 13 wherein said rear wall, said front wall, said bottom wall, and said contoured side walls define said collection reservoir having a rectangular cross-section.

* * * * *